United States Patent [19]

Dolby et al.

[11] 4,024,344

[45] May 17, 1977

[54] CENTER CHANNEL DERIVATION FOR STEREOPHONIC CINEMA SOUND

[75] Inventors: Ray Milton Dolby; Philip Charles Plunkett, both of London, England

[73] Assignee: Dolby Laboratories, Inc., San Francisco, Calif.

[22] Filed: Nov. 12, 1975

[21] Appl. No.: 631,319

[30] Foreign Application Priority Data

Nov. 16, 1974 United Kingdom ..... 49724/74

[52] U.S. Cl. ..... 179/1 G

[51] Int. Cl.[2] ..... H04R 5/00

[58] Field of Search ..... 179/1 G, 1 GQ, 1 GP, 179/1 VC, 1 AT, 15 BT, 100.4 ST

[56] References Cited

UNITED STATES PATENTS 2,137,032 11/1938 Snow ..... 179/1 G 3,772,479 11/1973 Hilbert ..... 179/1 GQ 3,883,692 5/1975 Tsurshima ..... 179/1 GQ

*Primary Examiner*—Douglas W. Olms

*Attorney, Agent, or Firm*—Robert F. O'Connell

[57] ABSTRACT

In a stereophonic reproduction system, especially for a cinema, a center channel signal is derived by combining left and right channel signals. In order to harden the center image, particularly in speech, the left and right channel signals are compared and, when they include significant amounts of correlated information, the relative gain of the center channel is enhanced by boosting the gain of that channel and/or cutting the gain of the left and right channels. The test for correlation of information is preferably restricted to speech frequencies and the enhancement of relative gain may be performed only at middle frequencies.

17 Claims, 12 Drawing Figures

CENTER CHANNEL DERIVATION FOR STEREOPHONIC CINEMA SOUND

This invention relates to stereophonic reproduction systems for auditoria such as cinemas.

It is possible to adapt the conventional dual-bilateral variable area optical sound track for stereophonic operation. The two halves of the track are separately modulated with the two stereo signals. This is relatively easily carried out for both recording and reproduction for two-channel stereophony, but the optical track problems are considerably greater for more than two channels. Thus, a practical optical stereo system may have to be confined to the use of only channels in two optical tracks or the two halves of one track. Two tracks and speaker systems provide good stereo reproduction for the middle and back areas of a cinema; however, on the sides, especially near the screen, there is a noticeable tendency for the stereo image to pull towards the side closest to the listener. This effect is caused by a combination of the difference in relative levels and first arrival times (precedence effect) of the sound from the two speakers. This shift of the stereo image is especially noticeable on speech, which is usually recorded to come from centre screen.

It is possible to record and reproduce using three separate channels, but if the three signals are mixed on playback for compatible monaural reproduction, (using a single scanning head), the centre channel sound is reproduced at a relatively low level. As an alternative, it has been proposed to use only a two-channel stereophonic recording with a centre loudspeaker fed from a mixture of left and right signals; this is useful for hardening the centre image and reducing the image shift effect for off-axis listeners. The signal level of the centre speaker should not be too high, as this will tend to destroy the stereophonic effect of the left and right channels.

It is the object of the present invention to provide a derived centre channel which is effective in hardening the centre image, especially for dialogue, and yet which does not unduly deteriorate the overall stereophonic effect.

According to the present invention, there is provided a circuit for deriving a centre channel signal in a stereophonic reproducing system, comprising left and right signal channels, a centre signal channel including means for combining signals from the left and right channels, and control means arranged to compare the signals from the left and right channels and to control the relative gains of the said channels in such a manner that the relative gain of the centre channel is enhanced when the compared signals include significant amounts of correlated or in-phase information.

When the signals do not differ significantly, (i.e., the signals are correlated), stereo information is absent and the circuit may be said to be operating in the mono mode. The enhanced relative gain of the centre channel then effectively hardens the centre image. Since this is of most significance in relation to dialogue, it is preferred that the control means operate in response to only the speech region of the audio frequency spectrum, say from 200 Hz to 2.5KHz, or even up to as low as 1 KHz. The amplitude and phase response of the recording and reproducing equipment is especially accurate in this region; accordingly, incorrect operation of the circuit is minimized.

A further refinement restricts the frequency range operated upon by the control means, i.e., the frequency range in which relative gains are varied, only to that which is important for localizing speech sounds. By the use of appropriate filters in the signal paths, the extreme bass frequencies can be excluded from the action (e.g., below 150 Hz) as well as the extreme high frequencies (e.g., above 8 KHz). In this way, the audibility of pumping and breathing effects can be reduced.

The enhancement of the relative gain of the centre channel can be achieved by increasing the gain of that channel (in the desired frequency range) and/or by decreasing the gain of the left and right channels, which can be called the outer channels.

When the compared signals do differ significantly in amplitude and/or phase, (i.e., are not well correlated), stereo information is present and the circuit may be said to be operating in the stereo mode. As will be explained below, the transition between mono mode and stereo mode may take place fairly abruptly or in a more gradual manner.

There are various possible ways of comparing the signals to determine whether they contain significant amounts of correlated or in-phase information. In the development of the invention so far, the circuit has been biased to remain in the mono mode under quiescent (no signal) conditions and to change to the stero mode when the stereo components reach a certain level. For example, the change to stereo can commence when stereo components reach − 30dB relative to total signal, the change being complete when the stereo components reach − 20dB. Thus, a kind of negative test is applied on the basis that, if the stereo components have risen to a certain level, the correlated or in-phase information can no longer be regarded as significant.

In one alternative a direct test is applied; the circuit is locked in the stereo mode unless the correlated components reach a level of at least −40dB, at which level an abrupt change is made to the mono mode or a gradual change is initiated. In another alternative, the circuit is locked in the mono mode under quiescent conditions and remains in this mode so long as the correlated components have at least some predetermined proportion of the total signal level, e.g., correlated components no lower than − 10dB with respect to total signal.

In one embodiment of the invention, the centre channel gain is depressed, by say 2½ dB, in the stereo mode, the outer channels being unmodified (0dB). In the mono mode, the centre channel gain rises to 0dB and the outer channel gains are depressed, by say 2½ dB. In another embodiment, all channel gains are unmodified in the stereo mode and, in the mono mode the outer channel gains are cut and the centre channel gain is boosted, in each case by say 2½ dB. Either of these alternatives alters the gain of the centre channel relative to the outer channels by 5 dB and tests have shown that this is about the maximum change permissible if the listener is not to be conscious of the operation of the circuit. On the other hand, tests have also shown that very large auditoria would require a total relative gain change of the order of 8 dB in order to ensure that the centre image is hardened even for the audience at the front sides without destroying stereo. The problem thus posed may be overcome by combining use of the present invention with the invention of copending application Ser. No. 603,670 according to which delays in the outer channels assist the centre channel to form a centre image by the precedence effect. The combined techniques enable good results to be obtained for larger auditoria than with the use of either technique alone.

It will be appreciated that the stereo image width is inevitably reduced in the mono mode (if stereo information is present at the same time as dialogue, but the reduction is slight and degradation minimal).

The invention will be described in more detail, by way of example, with reference to the accompanying drawings, in which.

Figure 1:
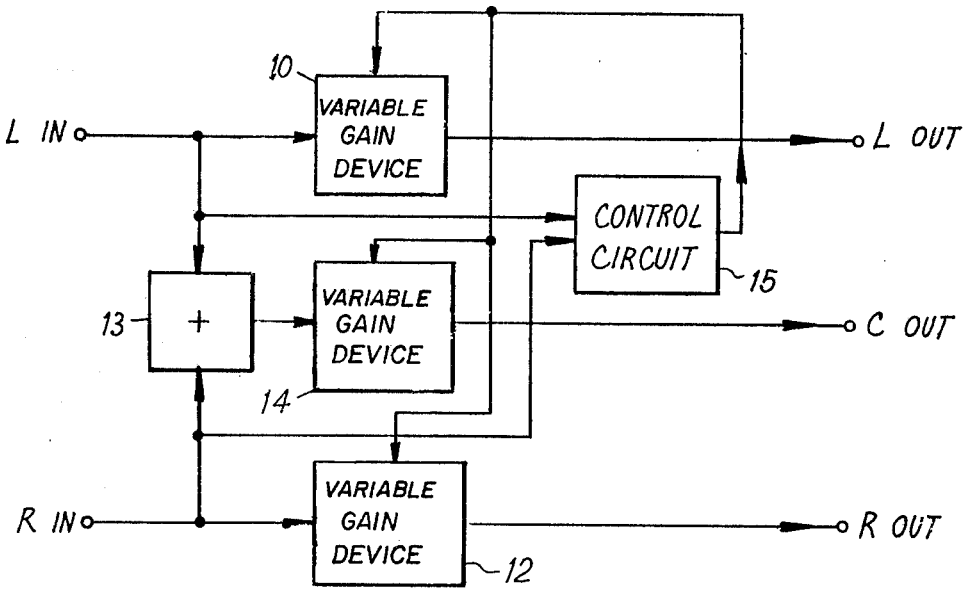
FIG. 1 is a simplified block diagram of a first embodiment.
Figure 2:
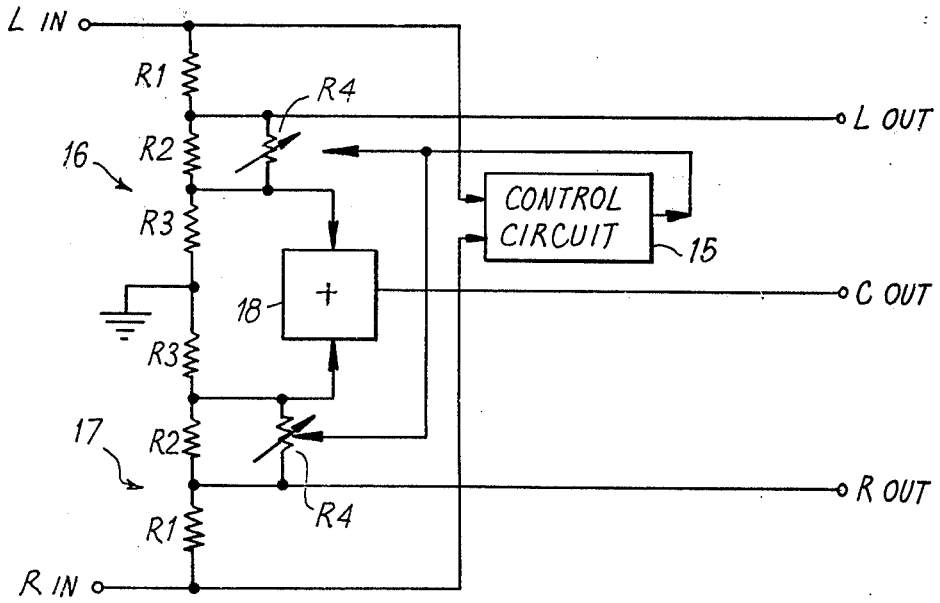
FIG. 2 illustrates a modification of FIG. 1.
Figure 3:
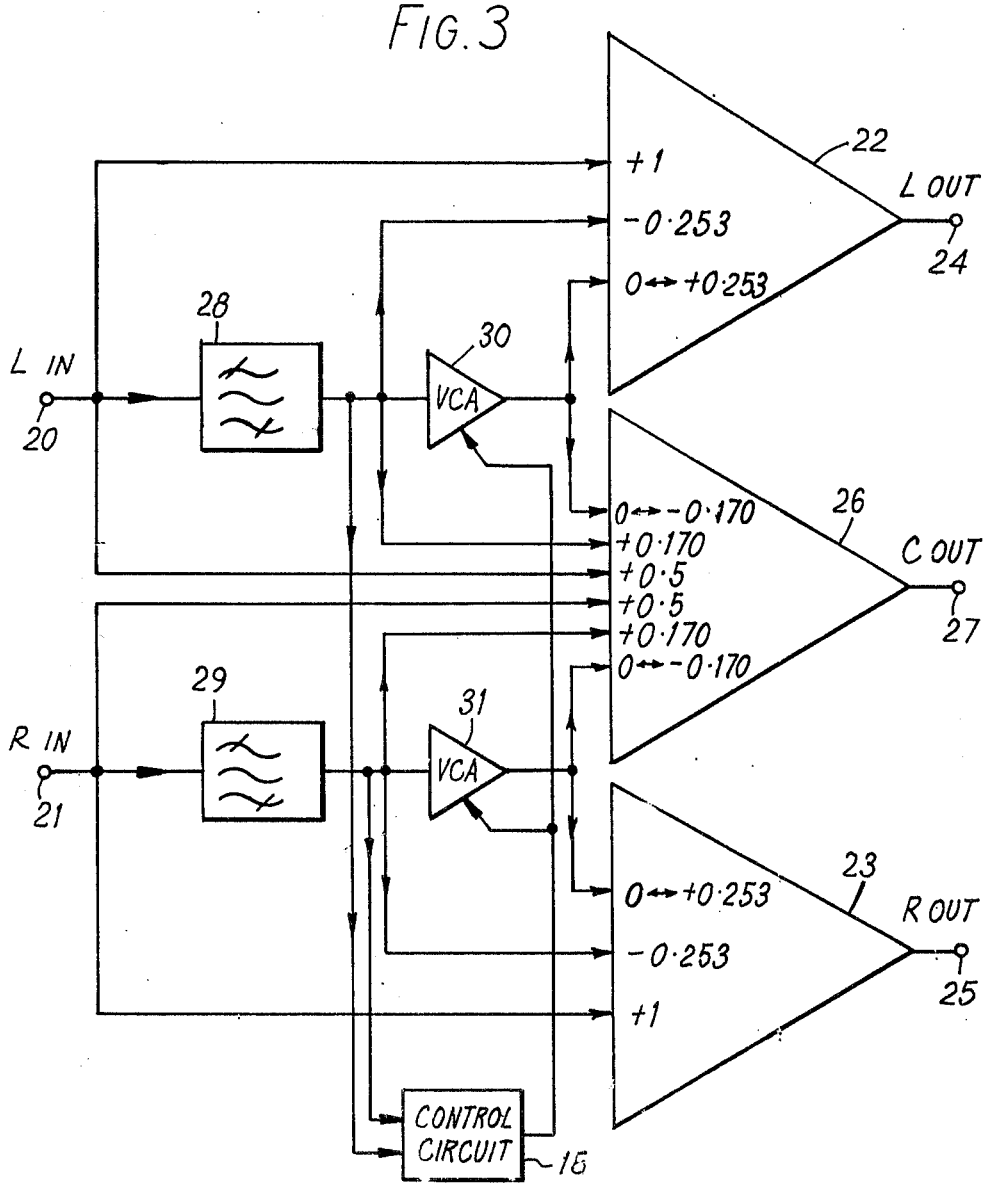
FIG. 3 is a block diagram of a second
Figure 4A:
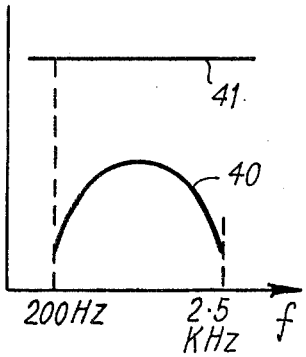
Figure 4B:
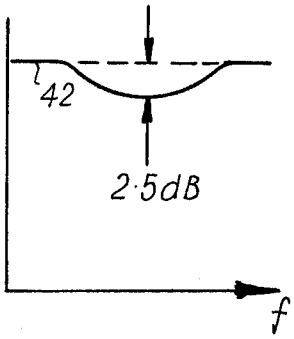
Figure 4C:
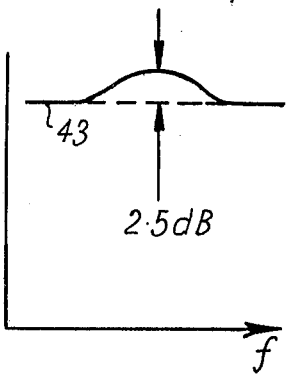
Figure 5:
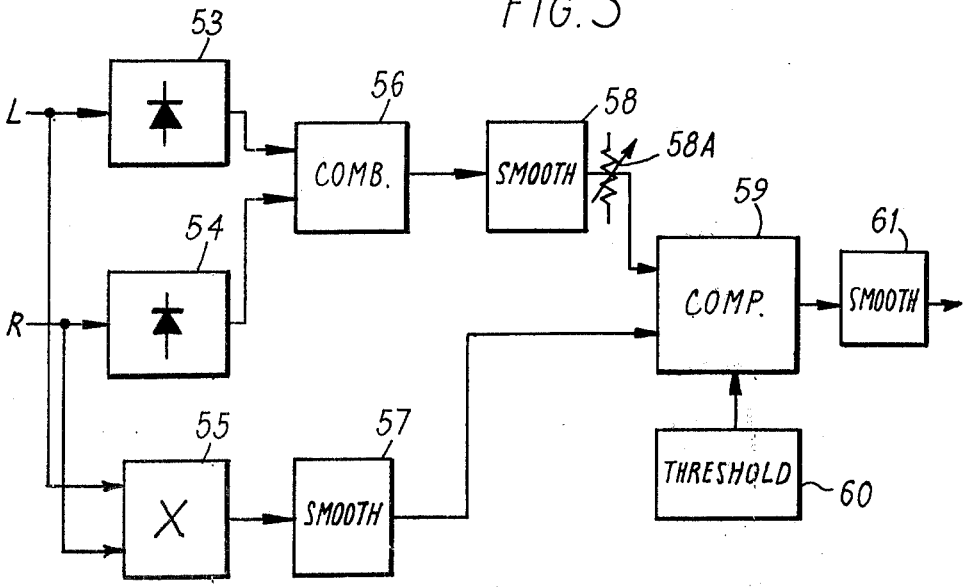
Figure 5A:
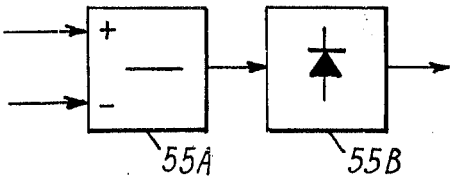
Figure 5B:
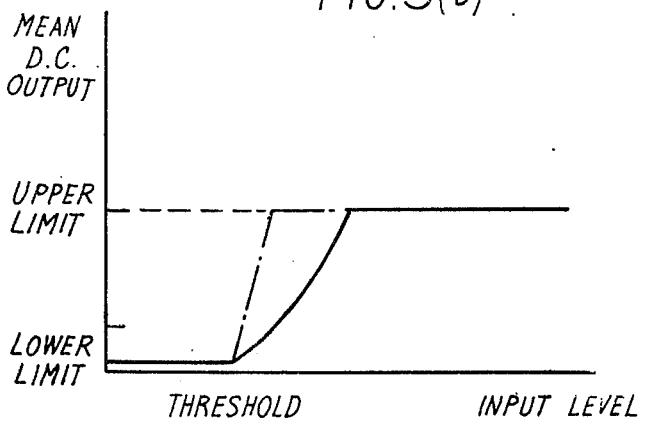
Figure 6:
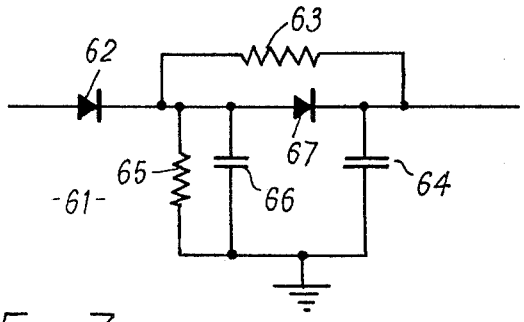
Figure 7:
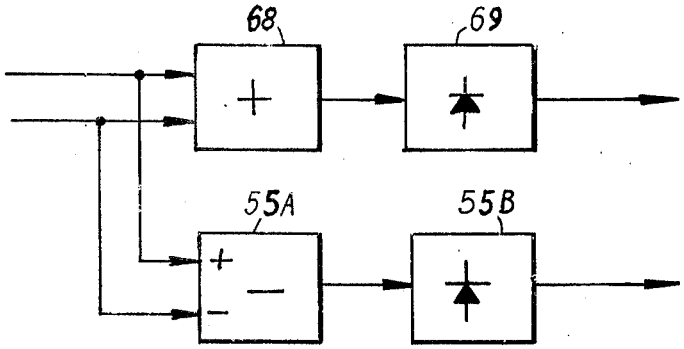

FIGS. 4(*a*), (*b*) and (*c*) show characteristic curves applicable to FIG. 3;

FIG. 5 is a block diagram of the control circuit for FIG. 1, 2 or 3;

FIG 5(*a*) shows a modification of FIG. 5;

FIG. 5(*b*) is an explanatory diagram relating to FIG. 5;

FIG. 6 illustrates a smoothing filter for the control circuit;

FIG. 7 illustrates a modified control circuit; and

Figure 8:
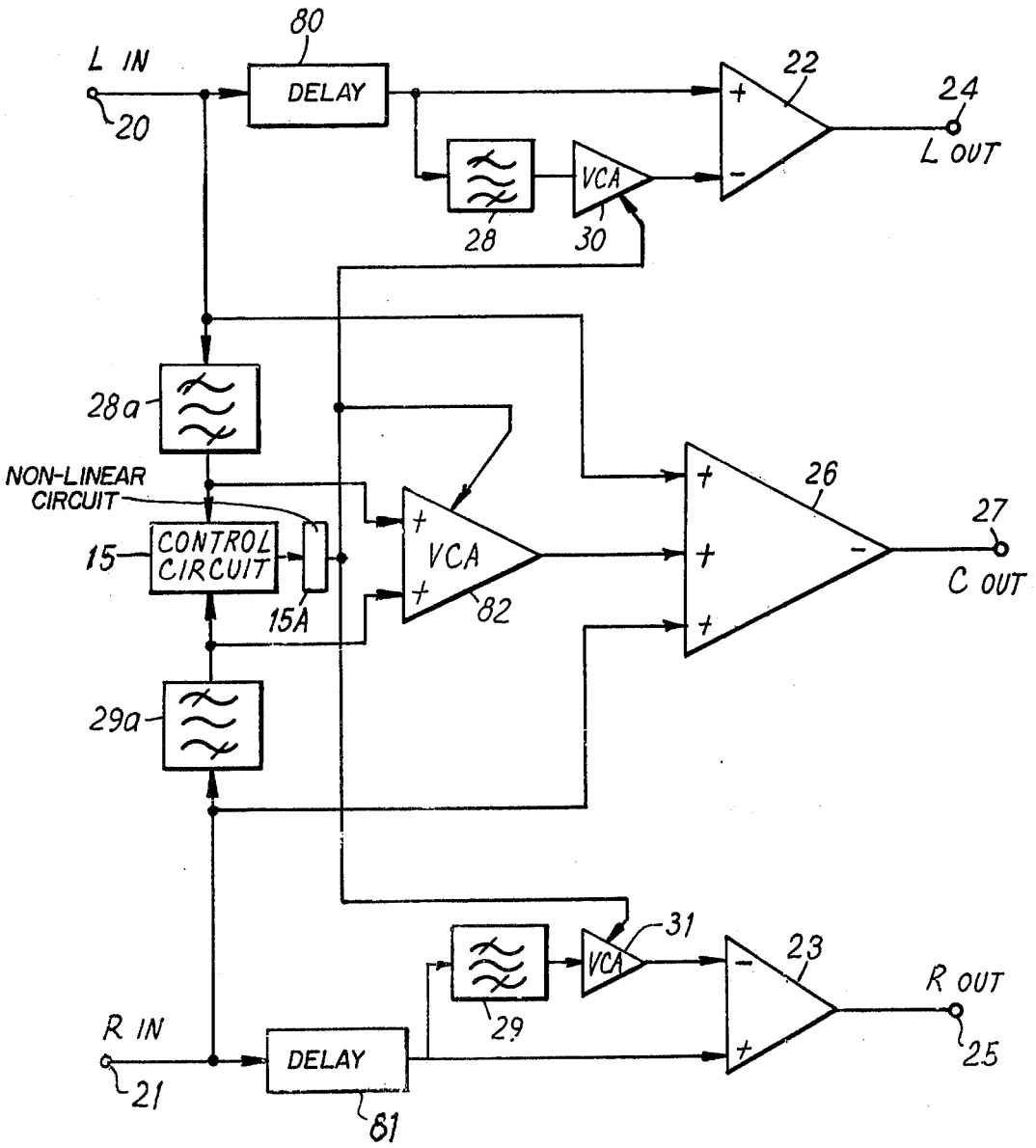

FIG. 8 illustrates a third embodiment in which delays are also used in the outer channels.

FIG. 1 shows left (L) and right (R) channels containing variable gain circuits 10 and 12 (which may comprise controlled amplifiers and/or attenuators) which may have a stereo mode (S) gain of 0dB. Signals from the two outer channels are simply added at a mixer stage 13 to provide a centre channel signal, although it is possible to employ phase shift and frequency conscious networks as well. The centre channel (C) includes another variable gain circuit 14 which has a stereo mode gain of − 2½ dB.

A control circuit 15 detects when stereo information is absent, or insignificant compared with mono information and provides a control signal which then, in the mono mode M, reduces the gains of the circuits 10 and 12 to − 2½ dB and raises the gain of the circuit 14 to 0dB.

In the modification shown in FIG. 2, only two, instead of three, controlled circuits are used. The relative gains are varied by two potential dividers 16 and 17, each comprising resistors R1, R2, R3. Centre channel signals are picked off across just the resistors R3 and combined by a mixing stage 18. The outer channel signals are, however, picked off in each case across R2 and R3. R2 is shunted in each case by a variable resistor R4 and the control circuit 15 now reduces the value of both R4 in the mono mode, which increases the centre channel gain and reduces the outer channel gains. This can be seen because the centre channel gain is determined by R3/(R1 + R2 + R3) which increases as R2 decreases, whereas outer channel gain is determined by (R2 + R3)/(R1 + R2 + R3) which decreases as R2 decreases.

For simplicity, FIGS. 1 and 2 have been shown as non-frequency selective circuits, although it is preferred that the inputs to the control circuit 15 be via middle frequency bandpass filters, restricting the stereo/mono control to the region of voice frequencies. FIG. 3 illustrates a practical embodiment which not only has this feature but also restricts the gain changes to the middle frequency band. Furthermore, use is made of a main (unmodified) and further (modified) signal path technique, as this tends to reduce distortion and make manufacturing reproducibility easier.

In FIG. 3, the left and right channel inputs 20 and 21 feed summing amplifiers 22 and 23 which feed the corresponding outputs 24 and 25. The inputs 20 and 21 also feed a centre channel summing amplifier 26 which feeds the centre channel output 27. In the amplifiers 22, 23 and 26, the symbols "+" and "−" are used to denote whether signals add or subtract and numerical quantities indicate relative levels of the signals which are combined. In accordance with well known practice, each summing amplifier may comprise cascaded, inverting operational amplifiers; whether a signal adds or subtracts is determined by which of the cascaded operational amplifiers it feeds. The circuits described so far provide main, unmodified signal paths.

The left and right inputs are also connected to bandpass filters 28 and 29 which may have a characteristic as shown at 40 in Figure (a), having − 3 dB points at 200 Hz and 2.5 KHz. The filters 28 and 29 feed the control circuit 15 and also feed signals at level − 0.253 to the summing amplifiers 22 and 23 respectively and at levels + 0.170 to the amplifier 26. These levels relate, by way of example, to the use of a 2½ dB boost and cut. The filters also feed signals to voltage controlled amplifiers 30 and 31 respectively whose gains are controlled by the circuit 15 and are relatively high and very small in the stereo and mono modes respectively. The amplifiers 30 and 31 provide further inputs to the amplifiers 22 and 23 respectively at level + 0.253 in the stereo mode (amplifier gains 30 and 31 high) but at level subsantially zero in the mono mode (amplifier gains 30 and 31 very small). Similarly, the amplifiers 30 and 31 provide further inputs to the amplifier 26 at levels − 0.170 in the stereo mode but at level substantially zero in the mono mode.

It can be seen that, in the stereo mode, the further path signals provided directly by the filters 28 and 29 and via the amplifiers 30 and 31 cancel each other out so that all three channels have a flat response. However, in the mono mode, only the signals provided directly by the filters 28 and 29 are effective and they boost the centre channel mid-frequencies and cut the outer channel mid-frequencies.

Thus, referring again to FIG. 4(*a*), the bandpass characteristic 40 is shown in conjunction with the flat response characteristic 41 provided by the unfiltered inputs to the summing amplifiers. FIG. 4(*b*) shows the combined response 42 of each outer channel in the mono mode while FIG. 4(*c*) shows the combined response 43 of the centre channel in the mono mode.

In FIG. 3, the same filters 28 and 29 select both the frequencies fed to the control circuit 15 and the frequency band within which relative gains are changed. Separate filters can be provided for these two functions, as in FIG. 8, so that, for example, the frequency band to which the control circuit 15 responds is narrower than the band within which relative gains are changed. As will be apparent from the example of FIG. 8, it is not necessary to use pairs of cancelling signals to modify the main path signals. In each amplifier 22 and 23, it is only necessary to use the main path signal plus a controlled subtractive signal. In the amplifier 26, it is only necessary to use the main path signals plus controlled additive signals.

The change from flat response to the characteristics of FIGS. 4(*b*) and (*c*) may take place abruptly (switched operation) or gradually, in which case there will be a transitional, "mixed mode" regime of operation in which the channel gains will vary through the values between flat and − 2.5 dB or + 2.5 dB.

The form of the control circuit 15 will be determined by the nature of the comparison effected between the outer channel signals, as discussed above. In the case in which the correlated information signal level is to be compared with a threshold, a conventional phase comparator with smoothing on the output may be used to detect the correlated information. For operation over a wide range of signal levels and in-phase or random phase signal conditions, it will usually be necessary to compare the correlated information not with an absolute threshold but with the total signal level. One form for the control circuit 15 operating on this basis is shown in FIG. 5. The left and right channel signals are assumed to be fed separately through two identical bandpass filters which ensure that the operation is determined by mid-frequency audio signals only, as these frequencies carry the significant speech information. The filtered left and right signals are rectified using precision rectifiers 53 and 54, and combined in a combiner 56 such that the output of the latter is the greater of the amplitudes of the left and right signals, this output being smoothed by a circuit 58 and representing total information.

The filtered left and right signals are also fed to a multiplier circuit 55 which forms a phase comparator of such a nature that its output is dependent only on correlated information. This output is smoothed by a circuit 57.

The smoothed correlated information is fed to a comparator 59, to be compared in amplitude to the smoothed peak signal level from the combiner 56. In the presence of only centre screen information (mono), there is a substantial output from smoothing circuit 57 and the comparator switches one way. When stereo information is present, the correlated information from the smoothing circuit 57 will be small compared with the signal from the smoothing circuit 58, and this will switch the comparator the other way. The state of the comparator 59 is in fact determined by the relative levels of the total information signal (from combiner 56) and the correlated information signal (from multiplier 55). The total information signal can be fed to the comparator 59 via an attenuator 58A. This attenuator determines the proportion of correlated information to total information signal level required for the comparator to consider the mono mode to exist. This feature allows for the fact that there may be some amplitude imbalance or slight delay or phase shift between the two channels. The comparator 59 thus compares the correlated signal with a threshold which is determined as a proportion of the total information signal.

A threshold control 60 may be used to preset an input level below which signals will not operate the comparator. In the absence of a large enough signal, (e.g., − 20dB to − 40dB), the comparator may be preset to assume either mode.

In a modification of the control circuit, operating with the above-mentioned "negative test," a different form of phase comparison is used to detect stereo information rather than correlated information. Thus, the multiplier 55 of FIG. 5 may be replaced by the subtracting circuit 55A and precision rectifier 55B shown in FIG. 5(*a*). The output of this rectifier thus has an amplitude proportional to the difference between the left and right channels. The subtracting circuit 55A will only produce an output if there is a difference in amplitude and/or phase between the left and right channel signals.

In this modification, the comparator 59 selects the mono mode except when the stereo information signal provided by the rectifier 55B exceeds the threshold established by the total information signal and attenuator 55A.

As shown, the control circuit has smoothing (circuits 57 and 58) before the comparator, but it may be preferred additionally or alternatively to provide a low pass filtering or smoothing circuit 61 after the comparator, in order to avoid introducing control voltage distortion in the programme output.

If required, the gain of the comparator 59 may be reduced so that the less abrupt transition is produced. This is achievable if the inputs to the comparator are unsmoothed; thus, over a certain range of input signals the output of the comparator switches between its limits at input frequency rate. This produces a square wave at the output of the comparator with a mark-space ratio which is dependent upon the input signal level and the smoothed wave gives a varying DC output. For input levels below the threshold, the output is latched one way. Pulses with a very small mark-space ratio will be produced by an input level just above the threshold. At high input levels the comparator remains at its highest limit.

FIG. 5(*b*) shows the comparator mean DC (smoothed) output plotted against relative(differential) input level, with a gradual change of output level above the threshold. The chain-dotted line shows the characteristic when switched operation is employed.

If the circuit is to be used to vary gain gradually, the smoothing filter 61 must be more sophisticated than a simple low pass filter, a suitable circuit being shown in FIG. 6. This achieves a fast response to rapid increases in signal level, coupled with a high degree of smoothing. A diode 62, resistors 63 and 65 and capacitors 64 and 66 provide conventional filtering while diode 67 speeds up the response to rapid increases in level.

The circuitry comprising devices 53 to 56 in FIG. 5 may be simplified as in FIG. 7 in which the phase and amplitude different information is obtained using the subtractor 55A and precision rectifier 55B as in FIG. 5(*a*). The left and right signals are, however, summed in an adder 68 and then rectified by a precision rectifier 69. The essential difference between FIG. 5 and FIG. 7 is that in FIG. 5 the combiner 56 feeds the comparator with a signal proportional to the amplitude of the greater of the left and right signals, whereas the rectifier 69 in FIG. 7 feeds a signal proportional to the amplitude of the sum of the left and right signals.

Mention has already been made of the additional use of delays in the outer channels. Suitable delays may be around 6 ms, or more, and delay devices (such as digital or charge — coupled delay devices) may simply be added on the output side of the circuits of FIGS. 1 to 3, e.g., after the amplifiers 22 and 23 in FIG. 3. However, it is preferred to insert the delay before the gain changing stages of the outer channels in order that the gain change in these channels may be anticipatory. A suitable circuit is shown in FIG. 8.

This circuit is similar to FIG. 3 but delay devices 80 and 81 have been inserted in the outer channels preceding the amplifiers 22 and 23 and filters 28 and 29, and furthermore each channel employs only a single modifying signal path which, in the mono mode provides a bucking signal in the amplifiers 22 and 23 and provides a boosting signal in the amplifier 26. As shown, the modifying paths feed forward to the amplifiers but the modifying paths could be in feedback relationship to the main paths. However, all signals fed to the amplifier 26 must be undelayed and inputs thereto are accordingly derived from points preceding the delay devices 80 and 81 and filters 28*a* and 29*a* provide the boosting signals for the centre channel. Furthermore, a separate voltage controlled amplifier 82 has to be provided for the centre channel. This amplifier sums inputs from the filters 28*a* and 29*a* and is controlled, along with the amplifiers 30 and 31 by the circuit 15. This circuit also receives undelayed inputs from the filters 28*a* and 29*a* so that the control of the centre channel is just as it is in FIG. 3. However, control of the amplifiers 30 and 31 is anticipatory because these amplifiers are after the delay lines 80 and 81.

FIG. 8 also illustrates a possibility applicable equally to other embodiments, wherein the control signal from the circuit 15 is modified non-linearly by a circuit 15A having a compression and/or expansion characteristic on the various levels of the control signal, in order to achieve the desired sharp or gradual change between modes. The non-linear network, or a plurality of non-linear networks may be situated at various points in the circuit 15 to co-operate with the dynamic behavior of the smoothing means, thereby to provide optimum response to high and low level correlated and uncorrelated signals under various transient conditions.

We claim:

1. A circuit for deriving a centre channel signal in a stereophonic reproduction system, comprising left and right signal channels, a centre signal channel including means for combining signals from the left and right channels, and control means arranged to compare the signals from the left and right channels and to control the relative gains of the said channels in such a manner that the relative gain of the centre channel is enhanced when the compared signals include significant amounts of correlated or in-phase information, said left and right signal channels each include means for delaying the output signals from the channels relative to the output signal from the centre channel.

2. A circuit according to claim 1, wherein the said enhancement of relative gain is controlled by signals restricted to a middle region of the audio frequency spectrum.

3. A circuit according to claim 1, wherein the said enhancement of relative gain is restricted to a middle region of the audio frequency spectrum.

4. A circuit according to claim 1, wherein the control means are operative both to boost the absolute gain of the centre channel and to cut the absolute gain of the left and right channels when the compared signals include significant correlated information.

5. A circuit according to claim 1, wherein the control means are operative to cut the absolute gain of the left and right channels when the compared signals include significant correlated information but to cut the absolute gain of the centre channel when the compared signals do not include significant correlated information.

6. A circuit according to claim 1, wherein the control means comprise means for utilizing signals from the left and right channels to provide an indication of the total signal present, means for forming the product of the signals from the left and right channels, and a comparator for comparing the total signal present with the product signal to provide a control signal which controls the relative gains.

7. A circuit according to claim 1, wherein the control means comprise means for rectifying signals from the left and right channels, means for combining the rectified signals to provide a total information signal, means for forming the difference between the signals from the left and right channels and for rectifying the difference signal, and a comparator for comparing the total information signal with the rectified difference signal to provide a control signal which controls the relative gains.

8. A circuit according to claim 1, wherein the control means comprise means for summing signals from the left and right channels, means for rectifying the sum signal, means for forming the difference between the signals from the left and right channels and for rectifying the difference signal, and a comparator for comparing the rectified sum signal with the rectified difference signal to provide a control signal which controls the relative gains.

9. A circuit according to claim 1, wherein the control means comprise first means responsive to signals from the left and right channels to provide a total information signal, second means responsive to signals from the left and right channels to provide a further signal varying in dependence upon the degree to which the signals in the left and right channels are correlated, and a comparator for comparing the total information signal with said further signal to provide a control signal which controls the relative gains.

10. A circuit according to claim 6, wherein the comparator has such gain as to switch abruptly between two extreme levels of the control signal.

11. A circuit according to claim 6, wherein the comparator has such gain as to effect a gradual transition between two extreme levels of the control signal as the difference between the compared signals varies over a predetermined range.

12. A circuit according to claim 9, wherein the comparator is biased to provide, under quiescent, no signal conditions, an extreme value of the control signal providing maximum enhancement of the relative centre channel gain.

13. A circuit according to claim 9, wherein the comparator is biased to provide, under quiescent, no signal conditions, an extreme value of the control signal providing none of the enhancement of the relative centre channel gain.

14. A circuit according to claim 1, wherein the left and right channels contain gain control means controlled by the control means, the delays precede the gain control means and the adding means in the centre channel have inputs connected to the left and right channels at points preceding the delays.

15. A circuit for deriving a centre channel signal in a stereophonic reproduction system, comprising left and right signal channels, a centre signal channel including means for combining signals from the left and right channels, each of the left and right signal channels including a main constant gain circuit for transmitting the corresponding signal from a corresponding channel input terminal to a corresponding channel output terminal, a variable gain circuit responsive to the said corresponding signal to provide a bucking signal component, and means for combining the said signal component with the said corresponding signal so as variably to buck said corresponding signal at said corresponding channel output terminal, and control means for comparing the left and right channel signals and operative to increase the gain of the variable gain circuits of both the left and right channels, thereby to increase the bucking of the left and right channel signals, when the compared signals include significant amounts of correlated or in-phase information.

16. A circuit according to claim 15, wherein the centre channel includes means for combining a constant gain signal from the left channel, a constant gain signal from the right channel, and a boosting signal, and a further variable gain circuit responsive to a signal from at least one of the left and right channels to provide said boosting signal, and wherein the control means is additionally operative to increase the gain of the further variable gain circuit, thereby to increase the boosting of the centre channel signal, when the compared signals include significant amounts of correlated or in-phase information.

17. A circuit for deriving a centre channel signal in a stereophonic reproduction system, comprising left and right channels, a centre signal channel including means for combining a constant gain signal from the left channel, a constant gain signal from the right channel, and a boosting signal, a variable gain circuit responsive to a signal from at least one of the left and right channels to provide said boosting signal, and control means for comparing the left and right channel signals and operative to increase the gain of the variable gain circuit, thereby to increase the boosting of the centre channel signal, when the compared signals include significant amounts of correlated or in-phase information.

* * * * *